United States Patent [19]

Adams

[11] Patent Number: 4,909,005

[45] Date of Patent: Mar. 20, 1990

[54] KEEPER CLIP FOR DOOR FRAME CASING ASSEMBLY

[75] Inventor: George C. Adams, Ann Arbor, Mich.

[73] Assignee: Rollform, Inc., Ann Arbor, Mich.

[21] Appl. No.: 295,443

[22] Filed: Jan. 10, 1989

[51] Int. Cl.[4] ..... E06B 1/52

[52] U.S. Cl. ..... 52/215; 52/656; 49/505

[58] Field of Search ..... 52/211–215, 52/656–658; 403/401, 402, 295; 49/505

[56] References Cited

U.S. PATENT DOCUMENTS

| | | | |
|---|---|---|---|
| 3,222,833 | 12/1965 | Woodrum | 52/211 |
| 3,259,409 | 7/1966 | Chappell et al. | 52/656 |

FOREIGN PATENT DOCUMENTS

| | | | |
|---|---|---|---|
| 2602230 | 4/1977 | Fed. Rep. of Germany | 52/656 |
| 2723717 | 7/1978 | Fed. Rep. of Germany | 52/656 |

*Primary Examiner*—James L. Ridgill, Jr.

*Attorney, Agent, or Firm*—Gifford, Groh, Sprinkle, Patmore and Anderson

[57] ABSTRACT

A keeper clip for securing the joints between casings of a type having a channel for attachment to a metal door frame. The keeper clip provides a secure and attractive joint without gaps or misalignment. The keeper clip has an elongated crosspiece extending between a pair of legs and an arm. Each of the pair of legs extend normally from an end of the crosspiece. The pair of legs and crosspiece thus form a U-shaped cross section for frictional reception within the channel of the header casing. The arm extends coplanar with the elongated crosspiece along the longitudinal axis of the header casing. The arm is resiliently deformable to receive an offset overlay of a side casing between the header casing and the arm. A portion of a free end of the arm is bent in a direction away from the header casing to permit easy insertion of the offset overlay. The keeper clip may be formed of a single strip of resilient material such as spring steel.

7 Claims, 2 Drawing Sheets

KEEPER CLIP FOR DOOR FRAME CASING ASSEMBLY

BACKGROUND OF THE INVENTION

I. Field of the Invention

The present invention relates generally to door frame casing assemblies and, more particularly, to a keeper clip for securely forming a joint between door frame casings or the like.

II. Description of the Prior Art

Door frames for wall openings for commercial buildings such as office buildings are typically constructed of metal and secured to wall studs by screws or the like. In order to cover the joint between the door frame and the wall, it is known to secure a casing or facing strip to the door frame so that the casing extends across and covers the joint between the door frame and the wall to present a more pleasing appearance.

Generally, each door frame is provided with a header casing and a pair of side frame casings. Each strip is generally channel-shaped, having an elongated base wall with a side wall extending substantially perpendicularly outwardly from the edge of the base wall. The header casing has a pair of ends which are formed to extend diagonally at a 45° angle with respect to the longitudinal axis of the header casing. Each of the side frame casings are provided with a complementary diagonally extending ridge with an embossed offset. The embossed offset extends from the diagonally extending ridge of the side casing to ride underneath the complementary diagonally extending end of the header casing to form a mitered joint.

As is disclosed in my prior U.S. Pat. No. 4,527,369, the header casing and side frame casings may be readily affixed to the door frame by way of a clip fastener formed of a band of spring steel. The band has two oppositely facing loops which frictionally engage the inner surface of the casings to secure the casings to the door frame. In this fashion, the casings may be quickly and securely attached to the door frame.

However, casings installed in this manner may occasionally separate or become misaligned at the joint between the header and the side casings. The separation or misalignment may typically result from settling or movement of the building or from failure to maintain proper tolerances during installation. The separation or misalignment at the joint may be unattractive. Thus, it would be advantageous to provide a casing assembly which forms a secure and attractive joint between the header casing and side casings and which may be easily assembled.

SUMMARY OF THE PRESENT INVENTION

The present invention provides a keeper clip for securing the joints between casings of a type having a channel for attachment to a metal door frame. The keeper clip provides a secure and attractive joint without gaps or misalignment.

The keeper clip according to the invention has an elongated crosspiece extending between a pair of legs and an arm. Each of the pair of legs extend normally from an end of the crosspiece. The pair of legs and crosspiece thus form a U-shaped cross section for frictional reception within the channel of the header casing. The arm extends coplanar with the elongated crosspiece along the longitudinal axis of the header casing. The arm is resiliently deformable to receive an offset overlay of a side casing between the header casing and the arm. A portion of a free end of the arm is bent in a direction away from the header casing to permit easy insertion of the offset overlay. The keeper clip may be formed of a single strip of resilient material such as spring steel.

The keeper clip according to the present invention thus provides a simple and inexpensive device for securing the joint between the side casings and header casings of a metal door frame. The casings may be readily assembled to form a joint and be readily installed on a door frame, thus providing a joint without unsightly gaps or misalignment.

BRIEF DESCRIPTION OF THE DRAWING

A better understanding of the present invention will be had upon reference to the following detailed description of the preferred embodiment when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
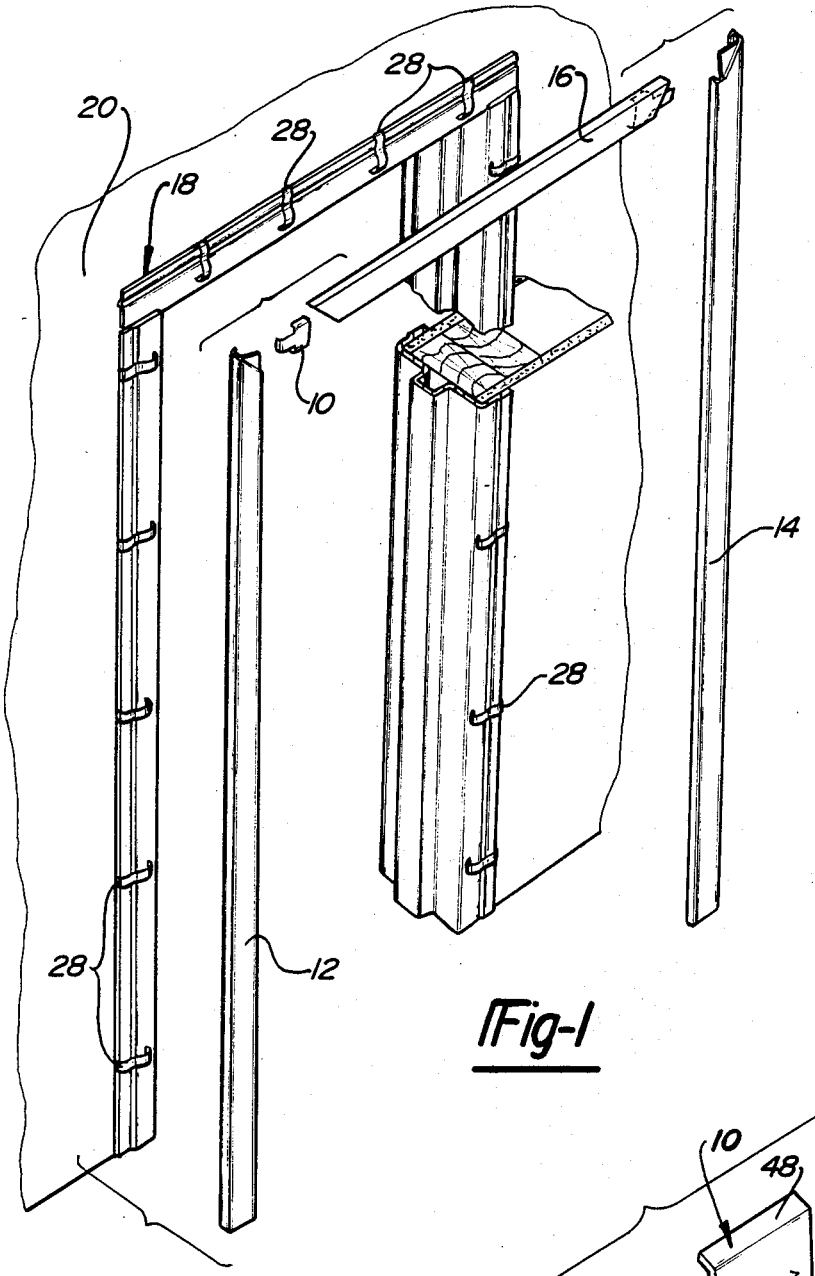
FIG. 1 is an exploded view illustrating a door frame header casing, a pair of side casings, and a keeper clip according to the invention.
Figure 2:
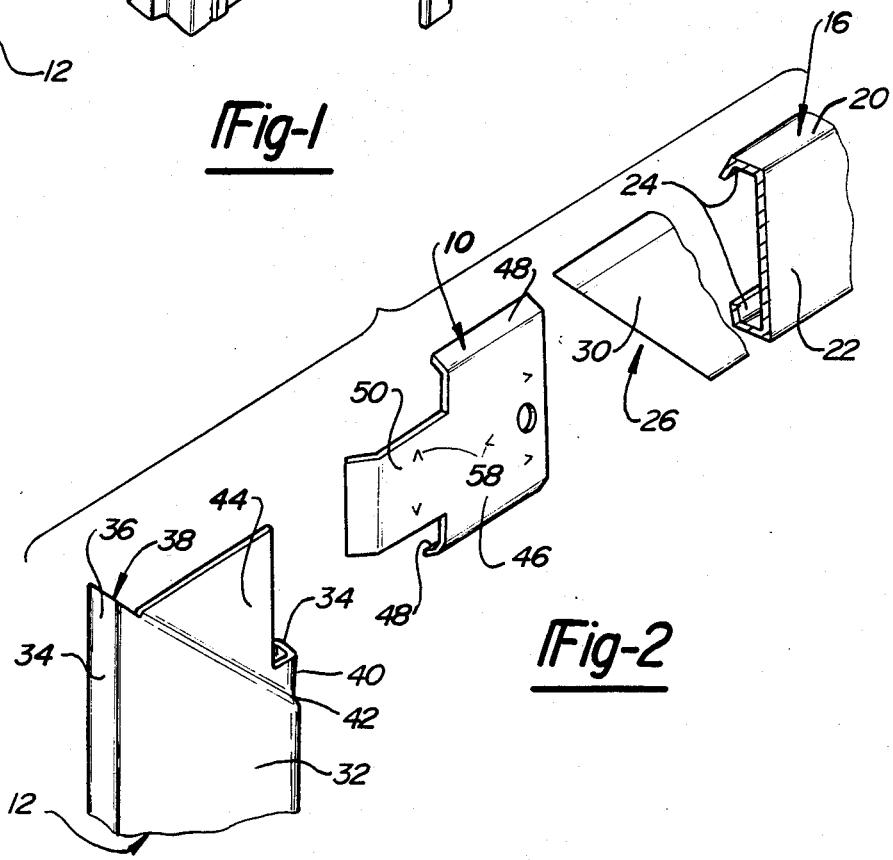
FIG. 2 is a fragmentary exploded view of a header casing, a side casing, and the keeper clip of the present invention.

With reference to FIGS. 1 and 2, a keeper clip 10 according to the invention for securing a pair of side casings 12, 14 to a header casing 16. As best shown in FIG. 1, the header casing 16 and the pair of side casings 12, 14 are mounted to a door frame 18 to cover a joint formed between the door frame 18 and a wall partition 20.

With reference to FIG. 2, the header casing 16 has an elongated base wall 22 extending between a pair of side walls 20. Each side wall 20 extends perpendicularly outwardly from the base wall 22 with each free end 24 of each side wall being bent slightly inwardly toward each other to form a C-shaped channel 26. As is more fully described in my previous Pat. No. 4,527,369, the header casing 16 and side casings 12, 14 are attached to the door frame 18 by engaging a plurality of fastener clips 28 within the channel 26 of the side casings 12, 14 and header casing 16. Each end 30 of the header casing is formed at a 45° angle to a longitudinal axis of the header casing for forming a miter joint with a respective side casing 12, 14.

As is shown in FIG. 2, each side casing 12, 14 is formed with a base wall 32, a pair of side walls 34, and inwardly angled free ends 36 forming a channel 38 having the same dimensions as the channel 26 of the header casing 16. One end 40 of the side casing is provided with an edge 42 extending diagonally from side wall to side wall at a 45° angle and an offset overlay 44 extending outwardly from the ridge. The edge 42 extends diagonally at a 45° angle to abut against and be complementary with the angled end 30 of the header casing in a mitered joint.

The edge 42 extends between a top surface of the base wall 32 and a top surface of the offset overlay 44 with a depth equivalent to the thickness of the base wall 22 of the header casing 16. As is known, the offset overlay 44 extends under the end 30 of the header casing when the joint is formed as shown in FIGS. 3 and 4.

As best shown in FIG. 2, the keeper clip 10 according to the invention has an elongated crosspiece 46 having a pair of legs 48 and an arm 50. The keeper clip is formed of a single piece of resiliently deformable material such as spring steel. The pair of legs extend normally from the crosspiece to provide a generally U-shaped cross section adapted to be received within the channel 26 of the header casing. The crosspiece 46 is dimensioned to extend within the channel 26 between the side walls 34 of the header casing. Each of the pair of legs 48 of the keeper clip extend between the base wall 22 and the angled free end 24 of the header casing. The legs of the keeper clip are angled outwardly slightly and are compressed between the side walls of the header casing. The keeper clip is thus, compressively and frictionally held in position within the channel of the header casing.

Figure 3:
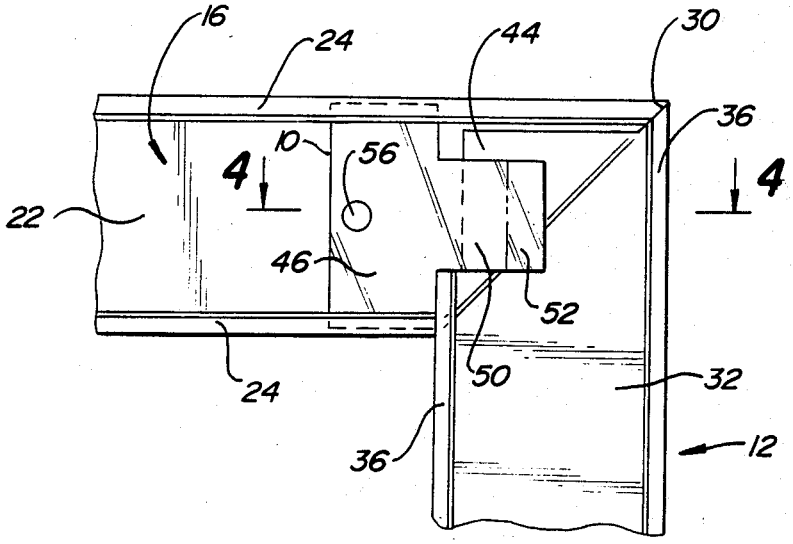
FIG. 3 is a rear view of an assembled joint with the keeper clip according to the invention.
Figure 4:
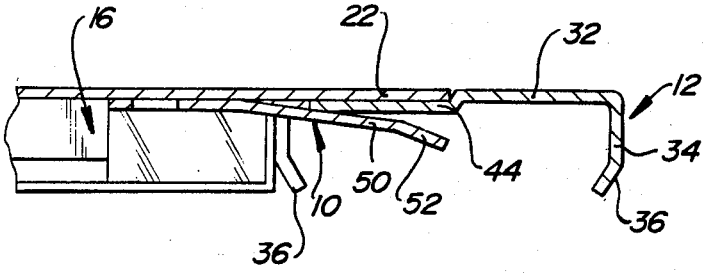
FIG. 4 is a sectional view of the keeper clip in position in a joint between a header casing and a side casing.

As best shown in FIG. 3, the arm 50 extends from the crosspiece 46 in a direction parallel to the longitudinal axis of the header casing. The crosspiece is positioned in the channel so that the arm 50 extends beneath the angled end 30 of the header casing 16.

The free end 52 of the arm 50 is bent slightly outwardly in a direction away from the base wall 22 of the header casing to form a gap 54. The gap 54 permits easy insertion of the offset overlay 44 between the arm 50 and the header casing 16, shown in FIGS. 4 and 5, as will be set forth more fully below.

As shown in FIG. 3, an aperture 56 is formed in the crosspiece 46 to permit engagement with a tool, such as an awl (not shown) for slidably moving the keeper clip within the channel of the header casing.

As shown in FIG. 2, a plurality of V-shaped points 58 are formed in the crosspiece 46 and arm 50 to frictionally engage the header casing and offset overlay to prevent slipping or dislodgement of the keeper clip 10. The plurality of V-shaped points 58 are formed by a suitable means such as stamping. The points 58 are disposed in directions opposing the longitudinal axis of the channel of the header casing and the side casing to prevent displacemnt of the keeper clip. On the crosspiece, two pairs of points 58 are aligned in opposing directions along the. longitudinal axis of the channel. Three points are fomed on the arm along an axis parallel to the longitudinal axis of the side casing 12 when the arm 50 of the keeper clip 10 is in engagement with the offset overlay 44 to prevent slippage of the side casing 12.

Figure 5:
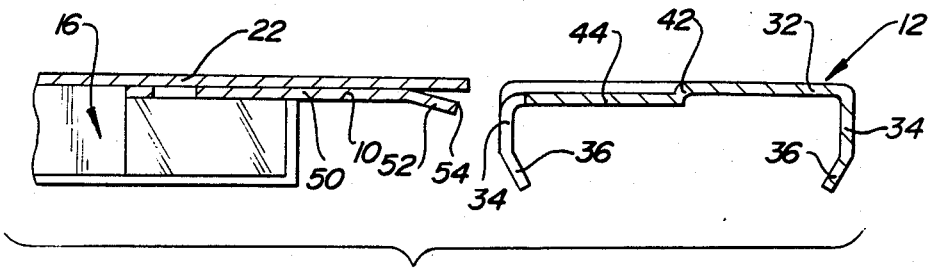
FIG. 5 is a sectional view of the keeper clip in a header casing in position for engagement with a side casing.
Figure 6:
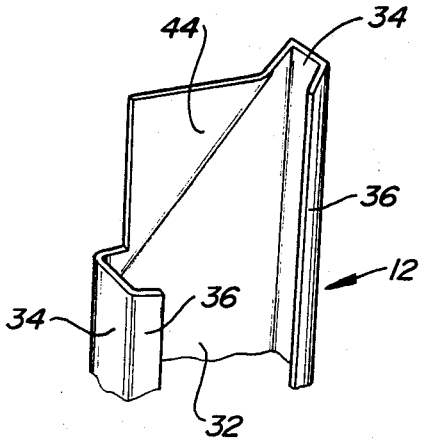
FIG. 6 is a perspective rear view of an offset overlay of a side casing.

As best shown in FIG. 5, the header casing and side casing are jointed by first positioning the keeper clip 10 within the channel 26 of the header casing 16. The keeper clip 10 is inserted in the channel of the header casing so that the legs 48 are fully received within the channel of the header casing 16. As best shown in FIG. 3, the keeper clip 10 must be inserted far enough into the channel so that the keeper clip 10 does not impede the insertion of the side walls 34 of the side casing 12. Since the legs of keeper clip are resiliently deformable, and because the legs are angled outwardly from each other, the keeper clip is biasingly and frictionally secured within the channel. As set forth above, the keeper clip may be positioned with a tool such as an awl. The keeper clip is preferably installed in each end of the header casing in the factory.

As shown in FIGS. 4 and 5, the header casing 16 and the side casing 12 are then assembled by sliding the offset overlay 44 of the side casing 12 into the gap 54 formed under the bent end 52 of the arm 50. The offset overlay 44 is then slid between the arm and base wall of the header casing until the edge 42 of the side casing 12 is seated against the angled end 30 of the header casing 16, to form a mitered joint.

Once the offset overlay is inserted into this position, the arm 50 of the keeper clip 10 biasingly and frictionally engages the offset overlay 44 to hold the casings in position. In the same fashion, the other side casing 44 may be jointed to the header casing. The joined casings may then be easily snapped on to the fastener clips 28 of the door frame 18.

Alternatively, the header casing 16 may first be snapped onto the door frame 18. Then the offset overlay 44 of the side casing 12 is slid into position between the keeper clip 10 and header casing 16 and the side casing is then snapped onto the fastener clips 28.

Having thus described my invention, many modifications thereto will become apparent to those skilled in the art to which it pertains without deviation from the spirit of the invention as defined from the scope of the appended claims.

I claim:

1. A keeper clip for joining a pair of casings, one of said pair of casings having an offset overlay, said each of said pair having a base wall and a pair of side walls spaced apart a predetermined width defining a channel, said clip comprising:

a crosspiece;

an arm extending from said crosspiece to frictionally and biasingly engage said offset overlay of said one of said pair of strips to form a mitered joint; and a pair of spaced apart deformable legs extending from said crosspiece, said pair of legs spaced a predetermined distance greater than said predetermined width of said channel such that said pair of legs biasingly contact said pair of side walls of said channel to maintain said clip in position within said channel.

2. The keeper clip of claim 1, wherein said pair of legs extend in a direction outwardly from each other to biasingly engage said channel of said other of said pair of casings.

3. The keeper clip of claim 1, wherein said arm has a free end portion angled outwardly away from said base wall forming a gap between said free end portion and said base wall for accepting said offset overlay of said one of said casings.

4. The keeper of clip of claim 1 further comprising a plurality of V-shaped points for engaging said pair of casings.

5. The keeper clip of claim 1, wherein said arm and said pair of legs are resiliently deformable.

6. The keeper clip of claim 1, wherein said keeper clip comprises a single sheet of spring steel.

7. The keeper clip of claim 1, wherein said crosspiece and said pair of legs are formed to provide a U-shaped cross section.

* * * * *